US006176726B1

(12) United States Patent
Kawakita

(10) Patent No.: US 6,176,726 B1
(45) Date of Patent: Jan. 23, 2001

(54) ELECTRICAL CONNECTION BOX INCLUDING A CONNECTOR HOUSING AND MATING CONNECTOR

(75) Inventor: Shinji Kawakita, Yokkaichi (JP)

(73) Assignee: Sumitomo Wiring Systems, Ltd. (JP)

( * ) Notice: Under 35 U.S.C. 154(b), the term of this patent shall be extended for 0 days.

(21) Appl. No.: 09/471,351

(22) Filed: Dec. 23, 1999

(30) Foreign Application Priority Data

Dec. 28, 1998 (JP) ..... 10-372618

(51) Int. Cl.[7] ..... H01R 4/50
(52) U.S. Cl. ..... 439/347
(58) Field of Search ..... 439/347, 352, 439/353, 354

(56) References Cited

U.S. PATENT DOCUMENTS 5,017,147 5/1991 Sugiyama et al. .
5,139,432 8/1992 Sugiyama et al. .
5,555,487 * 9/1996 Katoh et al. ..... 361/680
5,681,184 * 10/1997 Pamart et al. ..... 439/595
5,718,596 * 2/1998 Inaba et al. ..... 439/352
5,928,013 * 7/1999 Iwahori ..... 439/157
5,975,929 * 11/1999 Matsuura et al. ..... 439/157
6,045,375 * 4/2000 Aoki et al. ..... 439/157

FOREIGN PATENT DOCUMENTS 1-294382 * 11/1989 (JP) ..... 439/347

* cited by examiner

*Primary Examiner*—Steven L. Stephan
*Assistant Examiner*—Thanh-Tam Le
(74) *Attorney, Agent, or Firm*—Bierman, Muserlian and Lucas

(57) ABSTRACT

An electrical connection box having a main case, a connector housing therein, and a mating connector in the connector housing. There is an engagement section on one inside wall of the connector housing which engages the mating connector. There is also a support section on an inside wall of the connector housing with a retainer inserted therein. The retainer bears against at least a portion of the mating connector, thereby preventing it from slipping out of the connector housing.

12 Claims, 6 Drawing Sheets

ELECTRICAL CONNECTION BOX INCLUDING A CONNECTOR HOUSING AND MATING CONNECTOR

This Application claims the benefit of the priority of Japanese 10-372618, filed Dec. 28, 1998.

The present Invention relates to an electrical connection box for mounting in an automobile or similar vehicle. More specifically, it is directed to such a box having a double-engagement structure which prevents a mating connector, which has been inserted into the connector housing, from disengaging therefrom.

BACKGROUND OF THE INVENTION

Japanese laid-open utility model 4-36788 discloses a conventional electrical connection box of this type. A locking member is pivotally mounted on a connector housing disposed on the electrical connection box. A plate spring engagement section is located on the locking member. A plate spring is elastically disposed between the plate spring engagement section and the connector housing. In this electrical connection box, once the connector is inserted and fitted in the connector housing, the locking member is pivoted to the engagement position, working against the action of the plate spring. This engages and locks the connector.

However, in the conventional electrical connection box described above, dedicated equipment is needed to elastically dispose the plate spring in the electrical connection box and to mount the locking member. This increases production costs. Furthermore, since a plate spring is required, this also increases parts costs.

SUMMARY OF THE INVENTION

The object of the present Invention is to overcome the problems of the foregoing conventional technology and to provide an electrical connection box which eliminates the need for dedicated equipment and reduces production costs. Specifically, the present Invention provides for a double locking mechanism for securing the mating connector with the connecting housing.

The electrical connection box according to the present Invention comprises a main case, a connector housing therein, and a mating connector in the connector housing. There is an engagement section on a first inside wall of the connector housing which is in engagement with the mating connector. A support section is located either on the first inside wall or a second inside wall, the latter being spaced apart from the first inside wall. There is also provided a retainer in the support section which engages the mating connector and prevents it from slipping out of the connector housing.

The engagement section advantageously comprises a claw on the first inside wall and a protuberance on an adjacent wall of the mating connector. When installed, the protuberance on the mating connector is engaged by the claw on the first inside wall.

In a preferred form of the Invention, the support section includes an insertion opening and the retainer is an elongated member having a cross section which fits snugly in the insertion opening. The retainer extends through the insertion opening and bears against the mating connector. As a result, the mating connector is retained in the housing by both the engagement section and the retainer.

It is desirable that there be two support sections on either the first inside wall or the second inside wall. Such support sections are spaced apart from each other and it is advantageous that each has an insertion opening. In such a case, the retainer extends through both insertion openings in order to secure the mating section in the housing.

It has been found useful to provide the mating connector with a restricting portion which is adapted to underlie the retainer. Thus, the latter bears against this portion and thereby holds it within the housing.

If the support section is located on the second inside wall, the fact that it is remote from the first wall adds security to the retention of the mating connector. In this construction, the mating connector is held from both sides.

In a particularly desirable form of the Invention, each support section is provided with a pair of guide walls within which the retainer is held. It is also useful to have a guide projection partially occupying at least one insertion opening. This leaves a space constituting the remainder of the insertion opening and the cross section of the retainer is of substantially the same shape as the space. Most usefully, the cross section of the retainer is the same size or slightly larger than the space, whereby the retainer is held firmly therein. Most advantageously, the guide projection is in the form of an inverted trapezoid.

The retainer may comprise a pair of support plates, spaced apart from each other in a direction transverse to the insertion direction of the retainer and joined together by a connecting piece therebetween.

The Invention also contemplates the provision of a flexible piece on the connecting piece and adjacent a positioning end of the retainer. The flexible piece includes at least one stop which bears against the guide walls when the retainer is in the support section. Preferably, there is a pair of stops, each extending transversely to the insertion direction beyond the connecting piece. Thus, when the retainer is inserted into the insertion opening, the flexible piece is distorted thereby and, when it is through the insertion opening, its resilience causes the stop to resume its original shape, thereby securing the retainer in the support section. In a particularly preferred form of the Invention, the flexible piece is in the form of a trapezoid with the narrow end leading in the insertion direction. Thus, the angle of the trapezoid facilitates the distortion of the stop so that it can readily pass through the insertion opening and resume its original shape thereafter.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
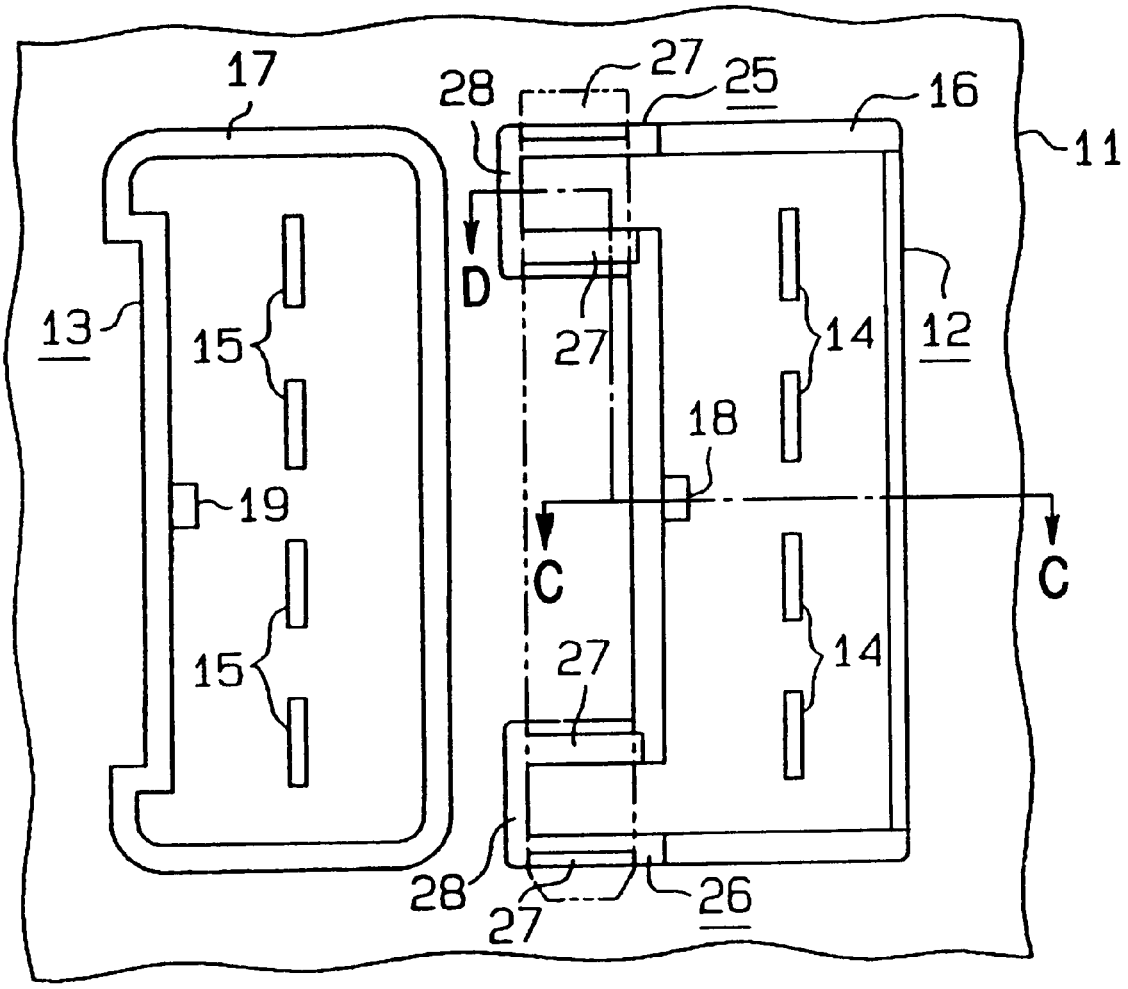
FIG. 1 is a fragmentary plan view showing an electrical connection box in accordance with the present Invention.
Figure 2:
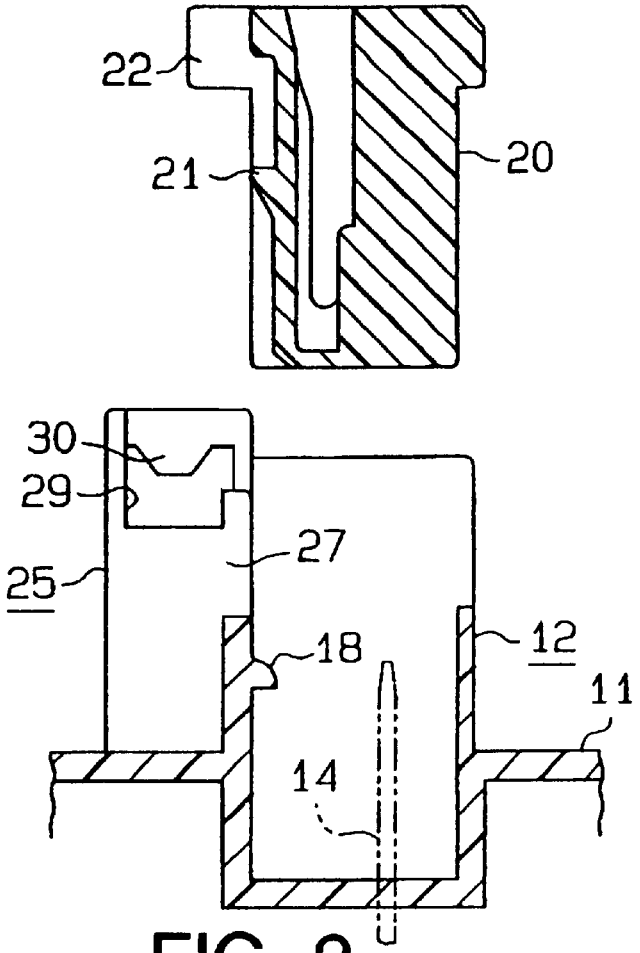
FIG. 2 is an exploded partial cross section illustrating the connector housing and its mating connector wherein the connector housing is taken along line C—C of FIG. 1.
Figure 3:
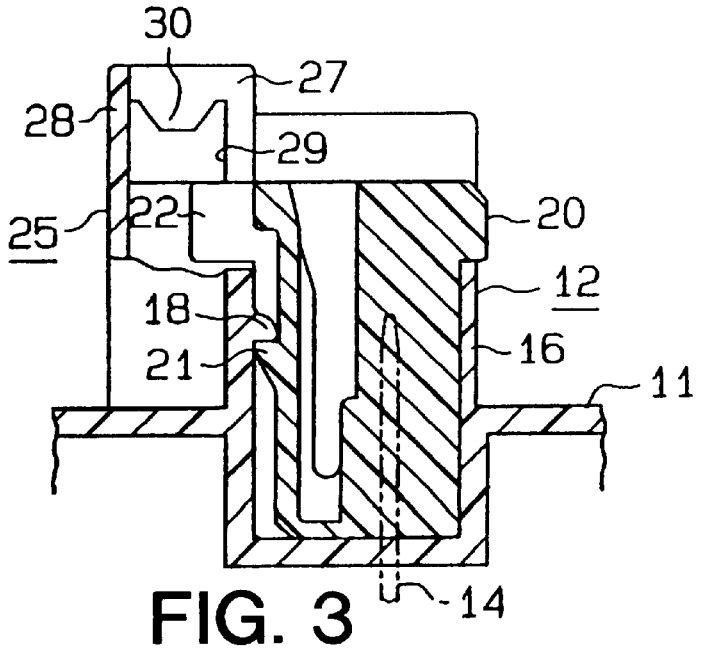
FIG. 3 is a view, similar to that of FIG. 2, wherein the mating connector has been inserted into the housing wherein the connector housing is mated with the mating connector and is taken along line C–D of FIG. 1.

As shown in FIGS. 1 to 3, main case 11 carries connector housings 12 and 13. Perimeter walls 16 and 17 enclose male terminals 14 and 15, respectively. Claws 18 and 19 are mounted on the inside of perimeter walls 16 and 17, respectively. Support sections 25 and 26 are provided with guide walls 27 and connecting walls 28.

As shown particularly in FIGS. 2 and 3, mating connector 20 is formed with protuberance 21 and restricting portion 22. It is inserted into the cavity of connector housing 12 and the female connectors (unnumbered) engage male terminals 14. Protuberance 21 is engaged by claw 18, thereby locking mating connector 20 to connector housing 12. Restricting portion 22 is beneath insertion opening 29, and guide projection 30, of inverted trapezoidal shape, projects partially into insertion opening 29.

Figure 4:
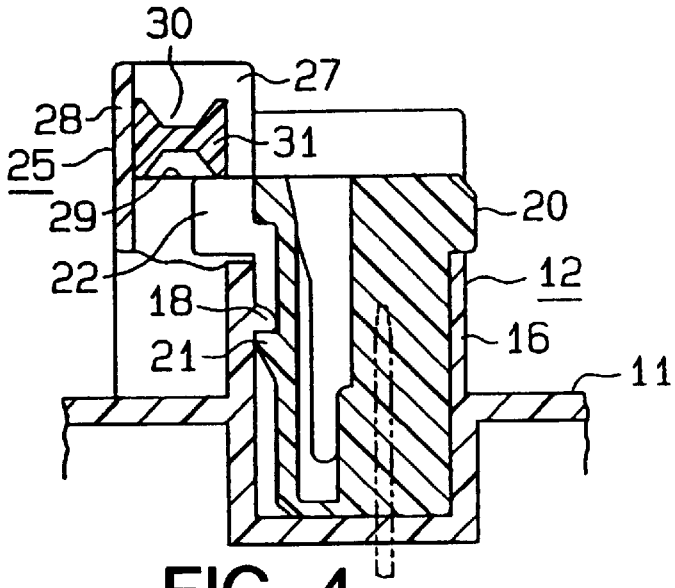
FIG. 4 is similar to FIG. 3 showing the guide projection and retainer in the insertion opening.

As can best be seen in FIG. 4, retainer 31 is inserted into support section 25 and bears against the lower portion of trapezoidal guide projection 30. It also bears against restricting portion 22, thereby securing mating connector 20 in housing 12. Thus, mating connector 20 is held in housing 12 both by the interaction of claw 18 and protuberance 21, as well as retainer 31 in support section 25.

Figure 5:
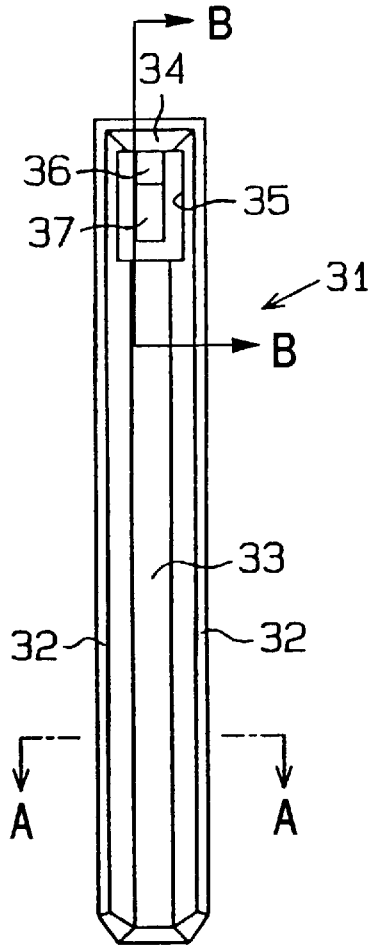
FIG. 5 is a plan view of the retainer.
Figure 6:
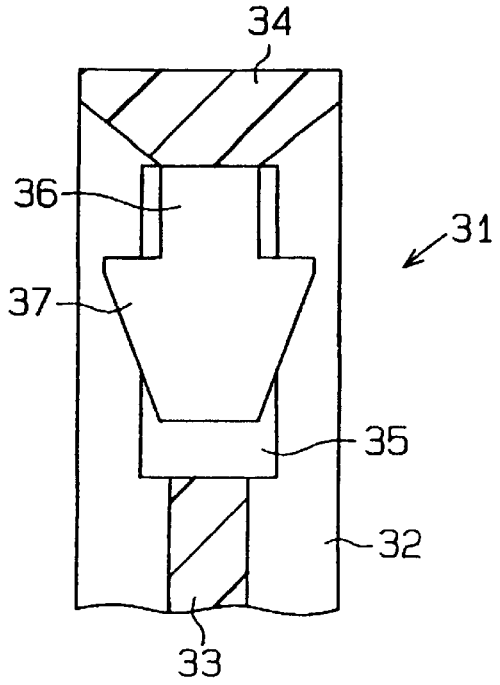
FIG. 6 is an enlarged plan view of the positioning end of the retainer taken along line B—B of FIG. 5.
Figure 7:
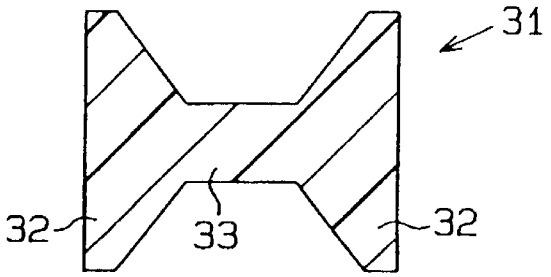
FIG. 7 is an enlarged transverse cross section of the retainer along line A—A of FIG. 5.

Referring more particularly to FIGS. 5, 6, and 7, retainer 31 comprises support plates 32 spaced apart from each other and joined by connecting plate 33. At positioning end 34, cavity 35 is provided around flexible piece 36 and stop 37. Flexible piece 36 includes stops 37 in trapezoidal configuration. Thus, when retainer 31 is inserted into support section 25, positioning end 34 trails. When stops 37 of flexible piece 36 contact the inner walls of insertion opening 29, they are distorted inwardly to allow the stop to pass through. Once this has occurred, stop 37 resumes its original shape and rear shoulders 38 bear against the perimeter of insertion opening 29, thereby securing both the retainer and the mating connector. In order to assist insertion of retainer 31 in opening 29, the end of retainer 31 opposite positioning end 34 is pointed, as shown in FIG. 5. If retainer 31 is to be removed, it must be pulled in its insertion direction so that stops 37 will be bent inwardly and positioning end 34 will be permitted to pass through the other insertion opening. Thus, mating connector 20 is doubly secured in housing 12.

Figure 8:
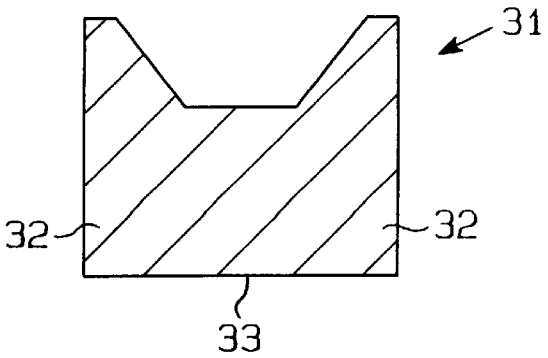
FIG. 8 is an enlarged traverse cross section of an alternate embodiment of the retainer.

Although only a limited number of aspects of the present Invention has been expressly described, such modifications as would be apparent to the person of ordinary skill may be made without departing from the scope or spirit thereof. For example, although two support sections 25 and 26 are shown on perimeter wall 16 of the connector housing, a single support section may be used or three or more such sections can be provided. The support sections are shown as being located on the same side of the connector housing as is claw 18. However, the support section(s) can be located on the opposite side of perimeter wall 16. This particular structure, with claw 18 and protuberance 21 in engagement on one side and retainer 31 in support section 25 on the other side, secures the mating connector in the housing in a particularly stable manner. Also, the cross section of retainer 31 may be varied so that instead of connecting plate 33 being located between the centers of support plates 32, it can be connected at the ends thereof. Protuberance 21 can be solid as shown in the drawings or hollow in a U-shape when viewed from above. Retainer 31 need only fit through opening 29, therefore, it may be U-shaped such that the upper portion of retainer 31 mates with the channel formed by guide projection 30 and the bottom of retainer 31 conforms to the shape of the bottom of opening 29 as shown in FIG. 8.

Figure 9:
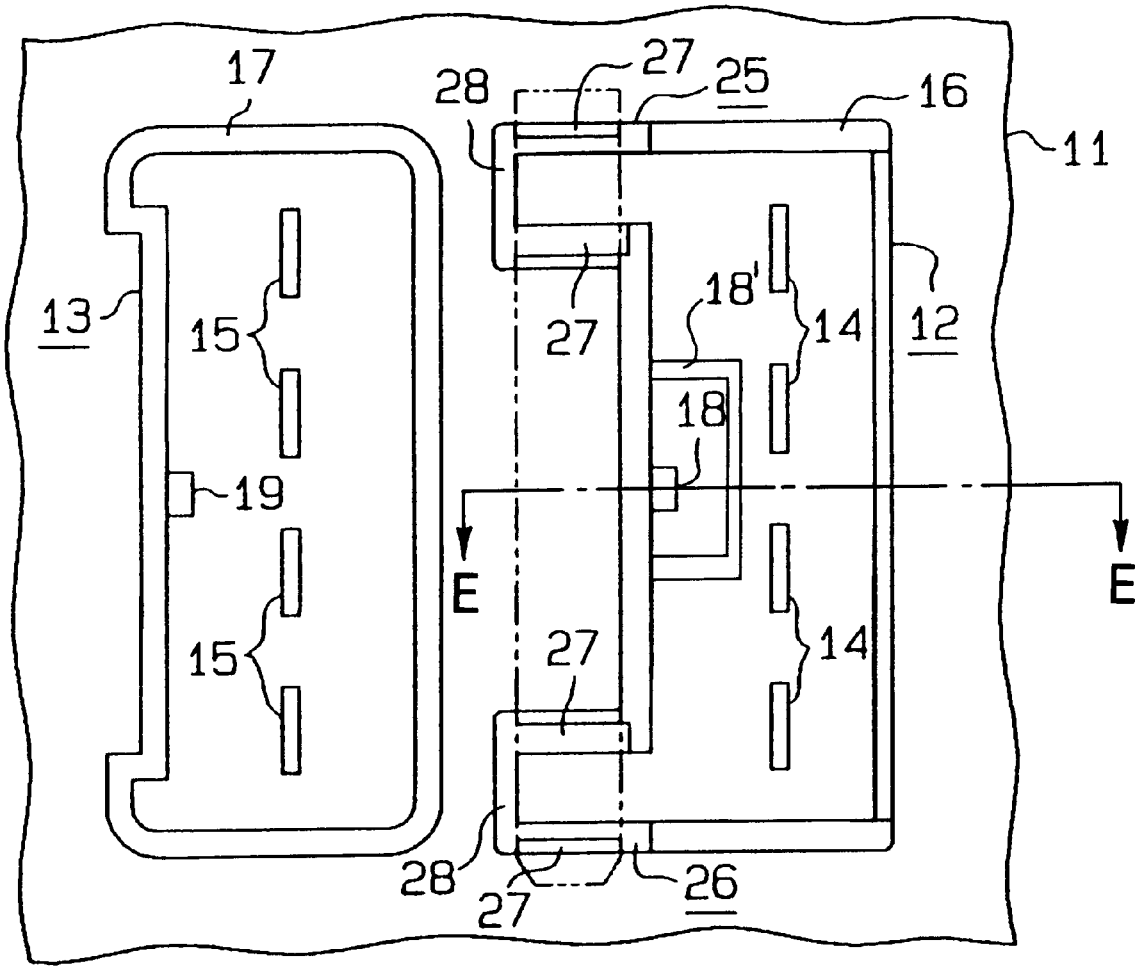
FIG. 9 is a fragmentary plan view showing an alternative embodiment of an electrical connection box in accordance with the present Invention.
Figure 10:
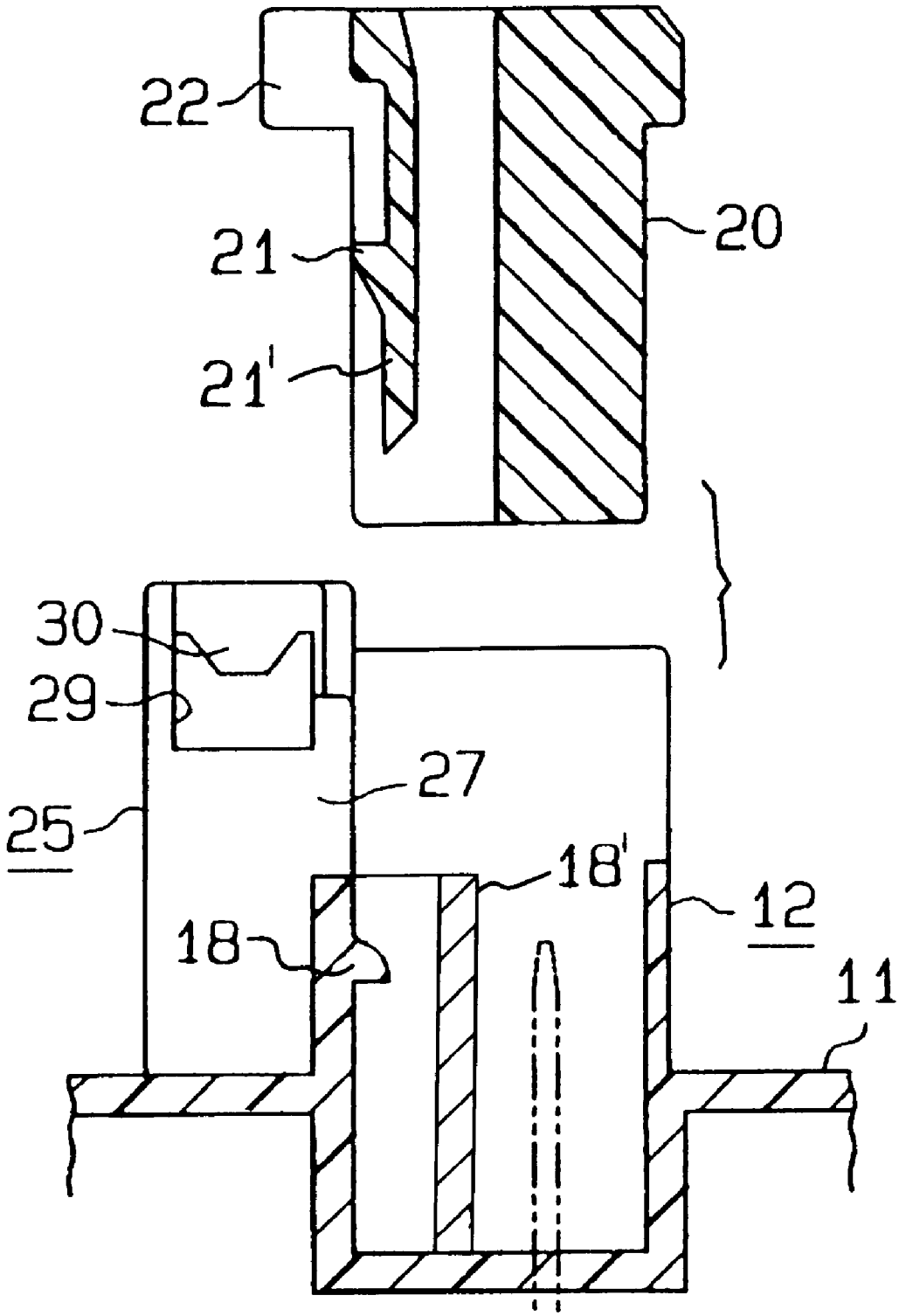
FIG. 10 is an exploded partial cross section illustrating the alternative embodiment of the connector housing and its mating connector taken along line E—E of connector housing in FIG. 8.

Another alternative embodiment is shown in FIGS. 9 and 10 wherein a wall 18' surrounds claw 18 and protects male terminals 14 from wall 21' upon which protuberance 21 is mounted. Wall 21', as shown, is connected to mating connector 20 at the top but not at the bottom. Thus, wall 21' hangs and fits into the cavity made by wall 18'.

These, and other such modifications may be made without departing from the spirit or scope of the present invention, which is to be broadly construed and not to be limited except by the character of the claims appended hereto.

What is claimed is:

1. An electrical connection box comprising a connector housing which mates with a mating connector, an engagement section on a first inside wall of said connector housing in engagement with said mating connector, a support section on said first inside wall or on a second inside wall of said connector housing, said second inside wall being remote from said first inside wall, a retainer in said support section, engaging said mating connector, and preventing said mating connector from slipping out of said connector housings said support section comprises an insertion opening said retainer comprising an elongated member having a cross section is substantially the same size as said insertion opening, said elongated member in said support section, extending through said insertion opening, and bearing against said mating connector, thereby retaining said mating connector in said connector housing;

said retainer comprises a pair of support plates spaced apart from each other in a direction transverse to an insertion direction of said retainer, and a connecting plate connecting said support plates to each other.

2. The electrical connection box of claim 1 wherein said engagement section comprises a claw on said first inside wall, there being a protuberance on an adjacent wall of said mating connector, said claw engaging said protuberance.

3. The connection box of claim 1 wherein there are two said support sections on said first inside wall or said second inside wall, said support sections being spaced apart from each other, said retainer in said support sections.

4. The connection box of claim 1 wherein there is a plurality of said support sections on said first inside wall or said second inside wall and spaced apart from each other, each said support section having one said insertion opening, said retainer extending through each said insertion opening.

5. The connection box of claim 1 wherein said mating connector has a restricting portion underlying said retainer, said retainer bearing against said restricting portion.

6. The connection box of claim 4 wherein there are two said support sections.

7. The connection box of claim 1 wherein said support section is on said second inside wall.

8. The connection box of claim 5 wherein each said support section has a pair of guide walls wherein said restricting portion is held.

9. The connection box of claim 1 wherein a guide projection partially occupies said insertion opening, thereby leaving a space in said insertion opening, said cross section being complementary to, and substantially the same as said space.

10. The connection box of claim 9 wherein said projection is an inverted trapezoid.

11. The connection box of claim 1 wherein said retainer has a flexible piece on said connecting plate, adjacent a positioning end of said retainer, said flexible piece including at least one stop which bears against guide walls in said support section when said retainer is in said support section.

12. The connection box of claim 11 wherein there are two stops, one on either side of the flexible piece.

* * * * *